United States Patent [19]

Cummings

[11] 4,162,793

[45] Jul. 31, 1979

[54] GAME SCORING SYSTEM

[75] Inventor: Gary J. Cummings, Torrance, Calif.

[73] Assignee: Mattel, Inc., Hawthorne, Calif.

[21] Appl. No.: 890,143

[22] Filed: Mar. 27, 1978

[51] Int. Cl.[2] ..... A63D 3/02

[52] U.S. Cl. ..... 273/121 A; 273/DIG. 26

[58] Field of Search ..... 273/121 A, 118 A, 119 A, 273/120 A, 122 A, 138 A, DIG. 26

[56] References Cited

U.S. PATENT DOCUMENTS

| | | | |
|---|---|---|---|
| 2,054,616 | 9/1936 | Durant | 273/121 A |
| 2,646,987 | 7/1953 | Hatherell | 273/121 A |
| 3,275,322 | 9/1966 | Burnside | 273/138 A X |
| 4,017,077 | 4/1977 | Burnside | 273/138 A X |
| 4,109,916 | 8/1978 | Breslow | 273/121 A |

*Primary Examiner*—George J. Marlo

*Attorney, Agent, or Firm*—John G. Mesaros; Ronald M. Goldman; Max E. Shirk

[57] ABSTRACT

A scoring system for an electromechanical game aparatus such as pinball or the like, the game including an operator selectable score altering mode on a given ball, for example, a "double or nothing" scoring feature, the selection being possible only once per player per game. A plurality of targets are associated with the selection and two registers are provided for monitoring game score as well as ball score for that play. The success or failure of the ball impacting the targets is monitored and at the conclusion of play of that ball the game score register is altered by the contents of the ball score register.

13 Claims, 4 Drawing Figures

DISPLAY
BALL SCORE REG.
SUBTRACT
ADD
GAME SCORE REG.
PROCESSOR UNIT
DELAY
SCORE DEVICE ENCODER
D/N
B/P
ONE SHOT
1 S
A SCORE DEVICE SWITCH
DOUBLE / NOTHING
BALL IN PLAY
BALL RETURN
RESET/ON
+V

GAME SCORING SYSTEM

BACKGROUND OF THE INVENTION

The background of the invention will be discussed in two parts:

1. Field of the Invention

This invention relates to electronic games and more particularly to an electromechanical game such as a pinball machine having scoring switches and targets.

2. Description of the Prior Art

In pinball machines and the like, a ball is propelled onto a playing surface which is usually inclined, the ball then impacting a number of targets any one or more of which may be associated with scoring which is then displayed on a display portion of the pinball machine. The operator of the machine has a limited amount of control of the location of the ball by "flippers" which may be disposed at various locations on the playing field, such flippers usually occurring in pairs in which event one or more pairs may be independently or simultaneously operable by the operator by depression of buttons located usually on the sides of the cabinet of the machine.

Such games may include one or more displays for displaying the cumulative game score for each player.

More recently, with the advent of electronic displays such as light emitting diode displays and the like, more recent pinball machines have only one digital display which retrieves from memory the score of the player then playing, the electronics of the machine being established to increment a player number register in response to depression of a reset, or player select button on the console. Such machines generally make provision for preselecting the number of players prior to the commencement of the game.

Such games have become increasingly popular, and due to the rapid advancement in technology with consequent reductions in price of solid state devices, such machines have become increasingly available for home use, rather than the prior limited use in arcades or the like.

The scoring in such devices is usually a given number of points for a particular target impacted or passed over with a bonus number of points when a certain series or plurality of targets have been impacted or illuminated on a given ball in play.

Usually, in a pinball machine game, be it electromechanical with an electromechanical scoring display, or in part electronic with an illuminated digital display, a player is normally entitled to play five (5) balls for one complete game. Generally, each player plays the first ball in sequence with the score for that player on a cumulative basis being shown on a separate electromechanical display or recalled from memory for display on a single electronic display. In either event, the score for that particular player on that particular ball is incremented on the display during play of that ball as each target is impacted or illuminated, with the overall score usually being dependent in large part upon the skill or adeptness of the player in manipulating the flippers. There is also an element of chance involved on any given ball, depending on the direction the ball takes relative to the flippers. The play then proceeds in sequence from player to player until the game is over.

It is an object of this invention to provide a new and improved scoring system.

It is another object of this invention to provide a new and improved scoring system which enables a player to select one ball during the game for receiving double the score or none of the score for that ball.

It is a still further object of this invention to provide a scoring system having a plurality of targets, which when activated with the operator selected control, doubles all points scored for that ball.

SUMMARY OF THE INVENTION

The foregoing and other objects of the invention are accomplished by providing an electronic game such as a pinball machine or the like having an operator selected control which may be selected once during the game by that player for providing a scoring bonus equal to the total number of points scored for that ball, the bonus being given in response to actuation of all of a plurality of target indicators from targets disposed about the surface of the playing field for impact or contact by the rolling ball during play. Means are provided for disabling the operator selectable switch if a ball is in play or if the particular player has previously selected the scoring feature previously during that game. A register under control of a processor takes the cumulative game score and adds all scoring occurring on that ball. A second register keeps score on only those points scored for that particular ball and after the ball has returned latch means determine the occurrence or non-occurrence of the plurality of target indicators, the occurrence thereof adding the contents of the ball score register to the game score register; and the non-occurrence subtracting the contents of the ball score register from the game score register.

Other objects, features and advantages of the invention will become apparent from a reading of the specification when taken in conjunction with the drawings in which like reference numerals refer to like elements in the several views.

DESCRIPTION OF THE PREFERRED EMBODIMENT

Figure 1:
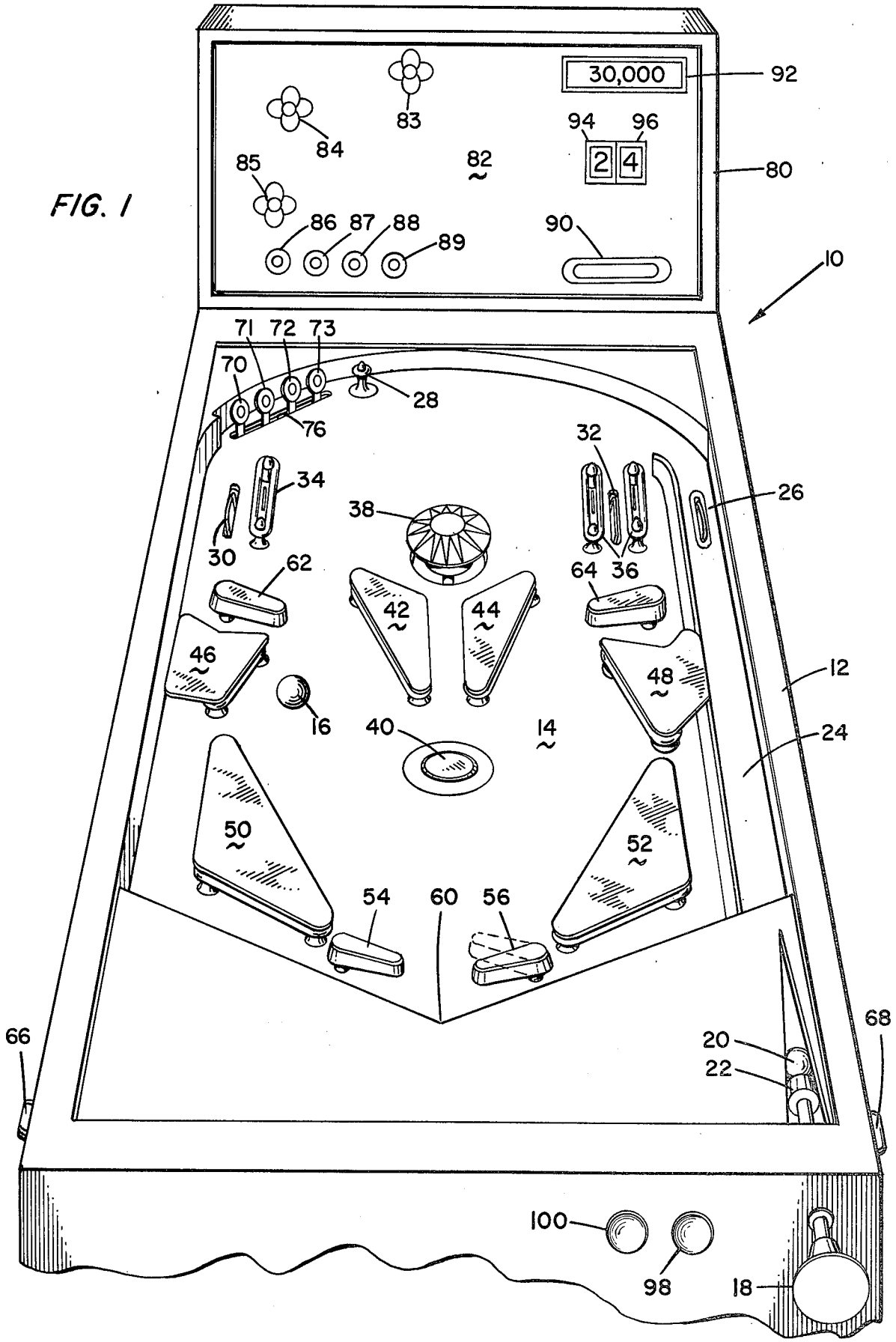
FIG. 1 is a perspective view of a pinball machine game according to the invention.

Referring now to the drawings and particularly to FIG. 1 there is shown a game apparatus such as a pinball machine generally designated 10 which has a playing console generally designated 12 with a playing field 14 upon which a ball 16, usually made of a heavy conductive material, rolls. The ball is put into play by a propelling mechanism including a spring loaded shooter knob 18 located on the exterior of console 12 for access by and operation by an operator. A ball in the position designated 20 is propelled by pulling back on the shooter 18 which is provided with a resilient end 22 which impacts against the ball 16 to drive it up a chute 24 to travel to the upper end of the playing surface 14 which is usually tilted to provide an incline down which the ball 16 travels. In the present invention, some means is provided for indicating that the ball 16 has exited the chute 24 and is therefore "in play" on the playing surface 14. Although the means for indicating that a ball is in play may take any convenient form, in the instant embodiment a switch 26 is positioned adjacent the exit end of chute 24 with traversal of the ball 16 over the switch 26 depressing a spring wire type switch of conventional configuration to thereby energize appropriate electrical circuitry to indicate that the ball is thus on the playing surface 14. During the commencement of travel of the ball 16 down the surface 14, the ball 16 may impact on non-scoring post members such as bumper 28, or it may pass over other switches such as 30 and 32 of conventional configuration having wire trip members extending upwardly through slots for depression by the ball 16 thereby actuating scoring means directly in indirectly. Each of the switches 30 and 32 may have disposed adjacent thereto suitable bumper or guide members 34 and 36 respectively which guide the ball over the respective switch. Centrally disposed adjacent the upper portion of the playing surface 14 is a solenoid actuated bumper 38 which may be of conventional configuration and operated by impact of the ball therewith to drive the bumper 38 downwardly toward the playing surface 14 to thereby redirect the ball 16 in a direction dependent upon the angle prior to impact. Other suitable scoring switches or means may be provided such as disc 40 below the bumper 38 on the opposite side of the guide members 42 and 44 which direct the ball toward the disc switch 40. Other "sling shot" mechanisms 46, 48, 50 and 52 may be provided with each of the sling shot mechanisms generally being formed of two or more upright posts encircled by a rubber ring member (or an electrically conductive garter spring operable in conjunction with a contact element on the playing surface 14) behind which may optionally be a switch operable upon impact of the ball 16 with the rubber ring member. The switch may conventionally operate a solenoid which actuates a pusher arm immediately behind the rubber ring or garter spring member to thereby redirect the ball 16 on the playing surface 14, and likewise, the switch may be enabled to operate a scoring means depending upon the design selected.

In addition to the stationary target objects, flipper mechanisms are provided, one pair 54 and 56 being disposed adjacent opposite sides of the center of the lower end of the playing surface 14 this being the ball return area 60 through which the ball returns to again be put in play by returning to the position designated 20 adjacent the end of 22 shooter knob 18. A second set of flipper mechanisms 62 and 64 may likewise be mounted adjacent opposite edges of the playing surface 14 toward the upper portion thereof. In any event, in conventional fashion the flippers are operator controlled by depression of suitable buttons 66 and 68 which are located on opposite sides of the console 12 for selective control by the operator.

Adjacent the upper left hand corner of the playing surface 14 as viewed in FIG. 1, there are four targets 70–73, each of which is generally perpendicular to the plane of the playing surface 14 with portions thereof extending downwardly through a slot 76 formed in the playing surface 14 with momentary closure switch means located below the surface, each of the targets in response to impact thereof by ball 16 actuating its corresponding switch. Extending upward from the rear of the pinball machine 10 is a display console 80 which usually contains a decorative surface 82 which is usually glass or plastic having painted on the reverse side thereof a design which may be translucent in parts, opaque in other parts, or unpainted to render it transparent. Certain portions of the decorative surface 82 such as the cloudburst designs 83–85 may be illuminatable in response to the occurrence of certain events on the playing surface 14, or alternately such lamps may be located on the playing surface 14, if desired. The four target symbols 86–89 may for example be illuminated in response to impact on any one of the targets 70–73 respectively with the illumination being maintained during play of that ball and being reset for the next player's turn.

Similarly, other areas of the decorative surface 82 or playing surface may have portions designated to convey certain information during play of the game. The elliptical area designated 90 may, for example, be illuminated in response to the selection by the operator of certain selections such as the "double or nothing" mode of scoring to be hereinafter described.

In addition with the electornic type scoring pinball machine of current manufacture a single scoring display 92 will be provided to display the cumulative game points for that player during his playing turn. Two other displays are illustrated, these being displays 94 and 96 with display 94 indicating the player number and display 96 indicating the ball currently being played by that player, for example, the display shows player number 2 now playing ball number 4. Alternately the player number and ball number may be displayed on display 92, then after a short time period, the player's score may be displayed, thus requiring only one display.

Additional control buttons 98 and 100 are provided on the front of the console 12 for selective operation by the operator. The control button 98 is the reset/on button which is depressed by the operator to start the game and by each subsequent player prior to commencement of the player's turn. The control button 100 is for selection of the "double or nothing" scoring mode to be hereinafter described.

Figure 2:
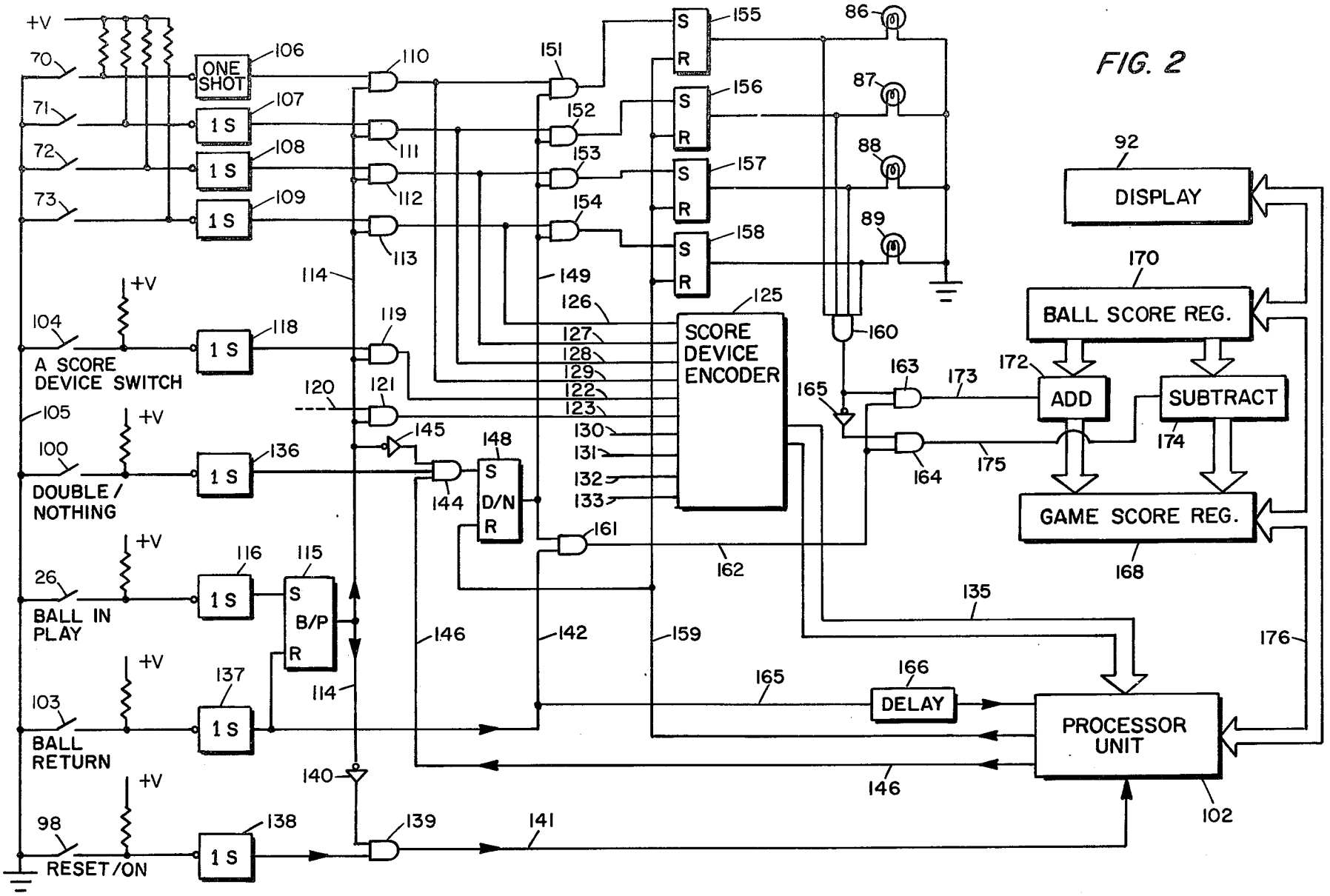
FIG. 2 is a block diagram illustrating the double or nothing scoring system according to the invention.

Referring now to FIG. 2, there is shown in block diagram form the scoring system according to the invention. The switches and lamps in the circuit diagram have been referenced with the same numerals as used for the physical switches and lamps in FIG. 1 for clarity of discussion. Essentially, the scoring of the game and progress of the game is controlled by a processor unit 102, which is activated by initial depression of the reset-/on button 98 with control and progress of the game being continually monitored by the processor unit 102. Briefly, the functions of the processor unit 102 are to (a) store all player scores, player double or nothing selections, current player number, and current ball number, this storage being accomplished in registers internal to the processor unit 102; (b) initialize a new game when a valid game reset pulse is received from switch 98, the processor unit 102 clearing all player score registers and player double or nothing selections, and initializing all other registers pertinent to the play of a new game, the processor unit 102 also counting the number of reset impulses to determine the number of players in the game; (c) initialize the system for each new turn, this being accomplished after a closure of a ball return switch to determine whether or not the game is over; and (d) update the contents of the game score register and ball score register during play of a ball.

In FIG. 2, in addition to the switches 70–73 associated with each of the targets, there is shown in FIG. 2 the double or nothing switch 100, the ball in play switch 26, the game on/reset switch 98, a ball return switch 103, and a score device switch 104, one end of each of the switches being tied together over lead 105 to ground. The ball return switch 103 may conveniently be a trip switch or contact switch located within the ball return area 60 of the playing surface 14. Each of the switches is a momentary closure switch normally designed to be operable in response to contact or impact. The other end of each of the switches is coupled to a suitable voltage source (+V) through an appropriate load register.

Each of the target switches 70–73 has the other end thereof connected to the input of a one shot multi-vibrator 106–109 respectively, the outputs of which provide a first input to all AND gates 110–113 respectively. The other inputs of the two-input AND gates 110–113 are tied together over lead 114 to the output of a "ball in play" latch 115 which has the "set" input thereof operative in response to the output of a one shot multi-vibrator 116 which is operative in response to closure of the ball in play switch 26.

The score device switch 104 has the other end thereof coupled to the input of a one shot multi-vibrator 118, the output of which is coupled to the first input of a two-input AND gate 119, the other input of which is connected to lead 114. The score device switch 104 may be associated for example with the disc switch 40, the bumper 38, or any other scoring device on the playing surface 14. A second score device switch for example may be connected to provide an input over lead 120 to a second AND gate 121, the outputs of AND gates 119 and 121 being respectively provided over leads 122 and 123 to a score device encoder 125 which likewise receives the output of AND gates 110–113 over leads 126–129 respectively. Similarly, other scoring switches may provide inputs over the leads 130–133 respectively to the score device encoder 125. The score device encoder 125 provides output data over data bus 135 to the processor 102, the information so provided being determined by the score attributable to the particular switch for the target or scoring device.

Each of the other switches such as double or nothing switch 100, the ball return switch 103, and the game reset/on switch 98 have the other ends thereof coupled respectively to one shot multi-vibrators 136–138 respectively. The output of multi-vibrator switch 138 provides a first input to AND gate 139 which has the second input thereof coupled through an inverter 140 to lead 114 which is the output from the ball in play latch 115. The output of AND gate 139 is transmitted over lead 141 to the processor unit 102.

The output of the one shot multi-vibrator 137 associated with the ball return switch 103 serves as a reset pulse for the ball in play latch 115, as well as providing an enabling pulse over lead 142 for scoring purposes as will hereinafter be described. The output of the multi-vibrator 137 is also provided to the processor unit 102 over lead 165 through a time delay 166.

The output of multi-vibrator 136 which is operative in response to actuation of the double or nothing switch 100 is transmitted as a first input to a three input AND gate 144, the second input of which is provided from processor unit 102 over lead 146, the pulse appearing on lead 146 only if the player has not previously selected the double or nothing mode of operation for that particular game. Assuming the pulse on lead 146 is enabling AND gate 144 provides an output to the set double or nothing latch 148 which provides an enabling pulse to lead 149 which provides a first input to AND gates 151–154 respectively, the other inputs of which are energized by the outputs of AND gates 110–113 associated with target switches 70–73 respectively. The outputs of AND gates 151–154 provide set pulses to latches 155–158 respectively, the latches 155 through 158 detecting the actuation of the targets and having the outputs thereof coupled to energize the scoring lamps 86–89 associated with the target switches 70–73 respectively. Additionally, the outputs of latches 155–158 are provided to the inputs of a four-input AND gate 160 which is enabled only if all targets have been successfully impacted, thereby illuminating all four target lamps 86–89. The processor unit 102 controls the resetting of latches 155–158 by directing a pulse over lead 159 to the reset inputs thereof.

The output of the double or nothing latch 148 appearing on lead 149 is also provided as first input to AND gate 161, the other input of which is the score enabling pulse received over lead 142 from the one shot multivibrator 137 associated with the ball return switch 103. The output of AND gate 161 is transmitted over lead 162 to the first inputs of AND gates 163 and 164 respectively, the other input of AND gate 163 being received from the output of AND gate 160, with the second input of AND gate 164 being inverted by inverter 165 from the output of AND gate 160. Thus, the outputs of AND gates 163 and 164 are mutually exclusive.

During play of the game, the scoring received from the score device encoder 125 passes through the processor unit 102 to be transmitted to a game score register 168, a ball score register 170 and to the display 92 with the game score register 168 being continually updated during play of the ball for that particular player on a cumulative basis. This game score is then displayed on display 92 on a continually updated basis. However, the ball score register 170 under control of the processor unit 102 has the contents thereof indicative of the total score for the particular ball in play with both registers 168 and 170 simultaneously receiving the ball score data. Depending upon the presence or absence of an output from AND gate 160, either AND gate 163 or AND gate 164 will be enabled to respectively provide an enabling pulse to an add unit 172 or a subtract unit 174 over leads 173 and 175 respectively. If, after conclusion of the ball in play, all four target lamps 86–89 are illuminated thus indicating a success on the part of the player, AND gate 163 will be enabled (thereby simultaneously disabling AND date 164) to thereby enable the add unit 172 to permit the contents of ball score register 170 to be added to the game score register 168 thereby effectively doubling the scoring for that particular ball. Conversely, if AND gate 164 is enabled due to one or more of lamps 86 through 89 not being illuminated, the subtract unit 74 is enabled to subtract the contents of the ball score register 170 from the game score register 168 thereby indicating failure.

With references to the switches designated in FIG. 2, the game reset/on switch 98 is actuated at the beginning of the game and prior to the commencement of play of each player in his turn. The total time duration of the scoring for that turn is the time interval between the ball in play switch 26 being activated and the time of the ball return switch 103 being activated, this time varying according to the skill of the player in keeping the ball in play.

At the outset of the game, the output of the ball in play latch 115 is low thereby enabling AND gate 139, and with momentary depression of the game reset/on switch 98, an enabling pulse appears on lead 141 to the processor unit 102 which directs the clearing of the ball score register 170, the game score register 168, and initializes all other registers internal to the processor unit 102 to indicate the play of a new game. The processor unit 102 also directs the display of the player number and ball number which may be displayed for example in displays 94 and 96 of FIG. 1 or if only one display is provided, this information will be displayed in display 92 for a short duration of time. In either event, the display will indicate the first player and the first ball for that player.

The player then retracts the shooter 18 to drive the ball 20 up the chute 24 whereupon it contacts switch 26 to indicate a "ball in play", this action setting the ball in play latch 115 to indicate the commencement of the scoring. The output of latch 115 goes high thereby enabling AND gates 110–113 as well as other score device AND gates 119 and 121. If the double or nothing switch 100 has not been actuated prior to commencement of play, the double or nothing latch 148 will have a low output thereby disabling AND gates 152–154 to thereby inhibit operation of the double or nothing latches 155–158 which respectively illuminate target lamps 86–89. However, as each of the targets 70–73 is respectively contacted, the outputs of AND gates 110–113 will be transmitted over leads 126–129 respectively to the score device encoder 125 for appropriating processing by processor unit 102 for storage in the game score register 168 as well as display on the display 92. As the ball 20 on the playing surface 14 impacts with various scoring devices, the score device switches 104 etc. will be activated to transmit pulses over leads 122, 123 and 130–133 to the score device encoder 125 for appropriate tallying during the play of that ball. As the ball 20 passes through the ball return area 60, the ball return switch 103 will be actuated thereby providing a pulse for multi-vibrator 137 to reset the ball in play latch 115 and provide a pulse over lead 165 through a suitable time delay 166 to the processor unit 102, thereby indicating the end of the playing time duration for that player.

The processor unit 102 then stores the information in an internal register relating to that player's turn as well as that player's game score. When the pulse is received from lead 165, indicating that a ball return switch closure has been made, the processor unit 102 determines whether or not the game is over by examining internal registers containing current player number and current ball number. If the game is still in progress, the processor 102 fetches the contents of the game score register 168 over data bus 176 and stores this information internally in the player score register corresponding to the last player. The ball score register 170 is then cleared and the game score register 105 is loaded with the contents, if any, corresponding to the next player's cumulative score, this score being within a register internal to the processor unit 102.

Assuming the next player desires to select the double or nothing scoring mode, the player then depresses the game reset/on switch 98, this pulse appearing on lead 141 to the processor unit 102 indicating the next player is ready to start. If the double or nothing switch 100 is then depressed, the output of multi-vibrator 136 is transmitted through AND gate 144 to set the double or nothing latch 148 thereby enabling AND gates 151–154 which trace the success or failure of impact on the target switches 70–73, while also enabling AND gate 161 which provides the required pulse necessary to manipulating the contents of the ball score register 170 and game score register 168 as required depending on the occurrence of events relating to the targets. Once that particular player has selected the double or nothing scoring mode, the processor unit 102 stores this information by that player number for the game at hand and provides an inhibit signal over lead 146 if required subsequently in the same game in the event the same player attempts to exercise the same selection a second time during the game.

Assuming a single display 92 is utilized, as soon as the next player depresses the reset/on switch 98, the display 92 will indicate the player number and ball number for that player, this information being displayed for a short time period, after which the display 92 then displays the total game score for that player to date.

Whether or not the particular player has previously selcted the double or nothing scoring feature, the processor unit 102 will provide a signal over lead 146 to enable or disable AND gate 144 which provides the set input to the double or nothing latch 148. Assuming, as previously indicated, the player has not previously selected the feature, lead 146 will go high and if a ball is not in play, the output appearing on lead 114 will be low, this signal then being inverted by inverter 145 to provide a second high input to AND gate 144 which, with the actuation of the double or nothing switch 100 will have a third high input from multi-vibrator 136 to set the double or nothing latch 148. Once the ball is in play, the ball in play latch 115 will be set to thereby enable the first inputs to AND gates 110–113 for the target switches 70–73 as well as the first inputs to AND gates 119 and 121 for the other scoring devices. As the ball impacts with a scoring device, the switch 104 will be momentarily actuated with this information being transmitted through AND gate 119 over lead 122 to the scoring device encoder 125. Depending on the scoring for the particular device, the encoder 125 will transmit data over data bus 135 to the processor unit 102 for suitable processing to the game score register 168 as well as the ball score register 170. The game score register 168, at its initial position, will have the cumulative results of all scoring on a current basis with additional scoring during play of a particular ball being cumulatively added to the game score register 168. The ball score register 170, on the other hand, will initially have a zero value prior to the placing of the ball in play, and will be successively incremented on a cumulative basis depending on the contents transmitted from the encoder 125 over the data bus 135 to the processor unit 102, the ball score register 170 maintaining a current picture of scoring for that particular ball. As each of the target switches 70–73 is momentarily actuated, the corresponding one of the AND gates 110–113 will provide an output over leads 126–129 respectively to the scoring device encoder 125 for scoring processing. Simultaneously, the output of AND gates 110–113 will pass through the enabled AND gates 151–154 to set the appropriate one of the target latches 155–158 with a corresponding illumination of the lamp 86–89 associated with the respective target. At the conclusion of the play of that ball, the ball return switch 103 will be actuated thereby disabling the ball in play latch 115 while enabling AND gate 161 over lead 142 to provide a scoring enabling pulse over latch 162. If less than all of the target latches 155–158 are set, at least one of the inputs to AND gate 160 will be low, thereby providing a low output from AND gate 160, thus disabling AND gate 163 while enabling AND gate 164 through inverter 165. With AND gate 164 disabled, a high output appears on lead 175 thereby enabling the subtract unit 174 to thereby subtract the contents of the ball score register 170 from the game score register 168, thus indicating failure on the part of the player. This action results in the game score register 168 as well as the display 92 reverting to the score had by the player prior to the start of play of that particular ball.

Conversely, if all of the target latches 155–158 have been set on that particular play of the ball, thereby indicating actuation of each of the target switches 70–73, the AND gate 160 will be enabled thereby enabling AND gate 163 while disabling AND gate 164. In this case, the output of AND gate 163 provides a high output over lead 173 to enable the contents of the ball score register 170 to be added to the contents of the game score register 168 through the add unit 172. The processor unit 102 then extracts the information regarding the game score for that particular player, this information then being stored in an internal register within the processor unit 102 for subsequent recall. As the ball return switch 103 is actuated, this information is likewise transmitted over lead 165 through a time delay 166 to the processor unit 102, the time delay of the delay 166 corresponding to the time necessary to evaluate the success or failure for that particular player during that play of the ball, and to process the information regarding the player's score and the like.

If a ball is in play when the double or nothing switch 100 is depressed, the ball in play latch 115 will be set, thus providing a high output on lead 114, the output being inverted through inverter 145 to provide a low input to AND gate 144 thereby precluding the setting of the double or nothing latch 148 once a ball is in play.

Upon the next depression of the game reset/on switch 98, the processor unit 102 then repeats the operation previously described, that is, it addresses that player's registers internal to the processor unit 102 to display sequentially the player number and ball number as well as the game score for that particular player. Likewise, processor unit 102 will determine whether or not that player has previously selected the double or nothing scoring mode for providing an appropriate signal as required over lead 146 to enable or disable the double or nothing AND gate 144. During commencement of play, the contents of each of the ball score register and game score register 168 are incremented equally depending on the scoring as determined by appropriate switch closures sensed by the score device encoder 125. When the game is complete, the processor unit 102 senses this information by the number of players originally selected and the number of balls played by each player.

Figure 3:
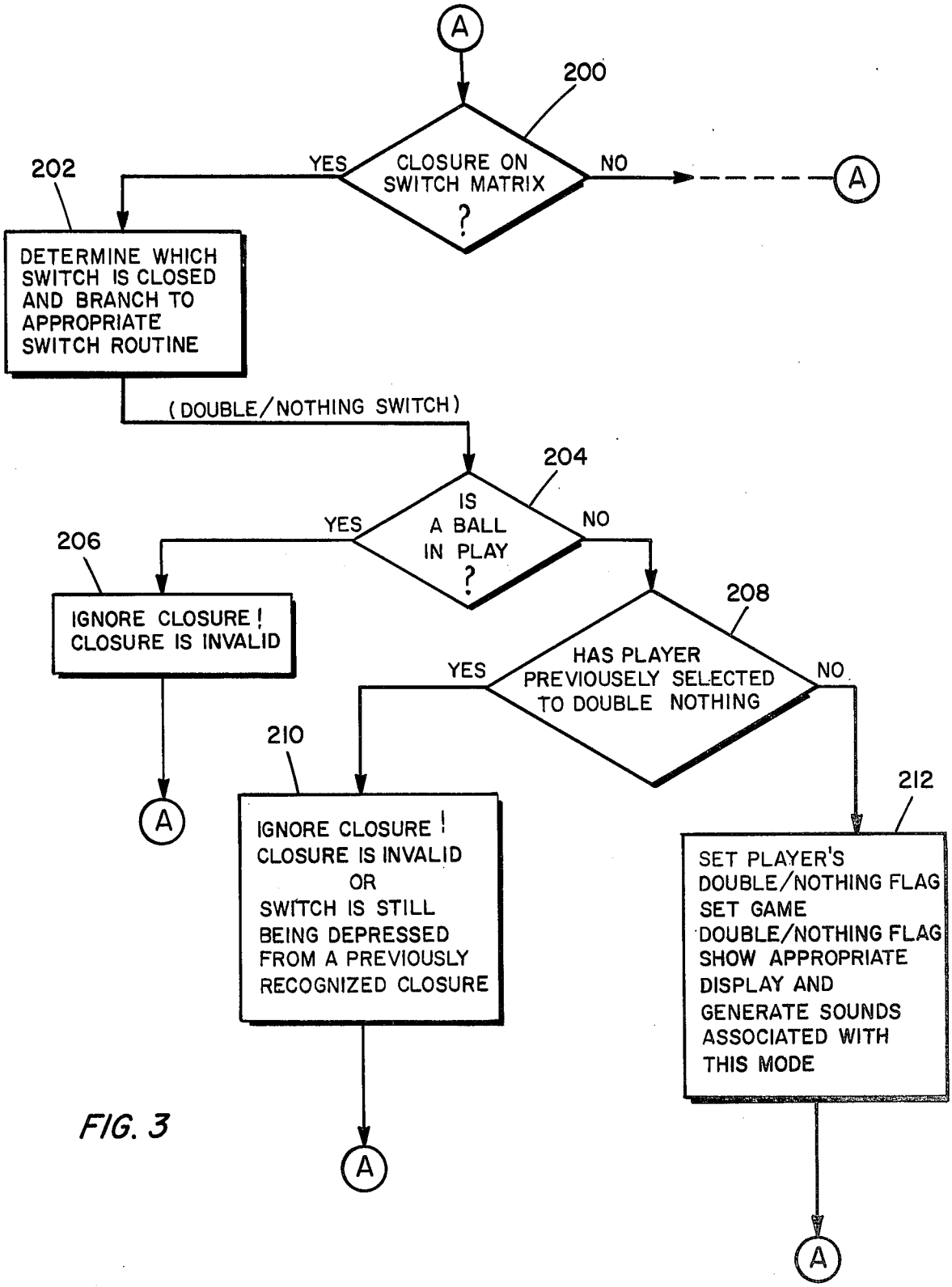
FIG. 3 illustrates in flow chart form the processor's sub routine for the double or nothing scoring mode.
Figure 4:
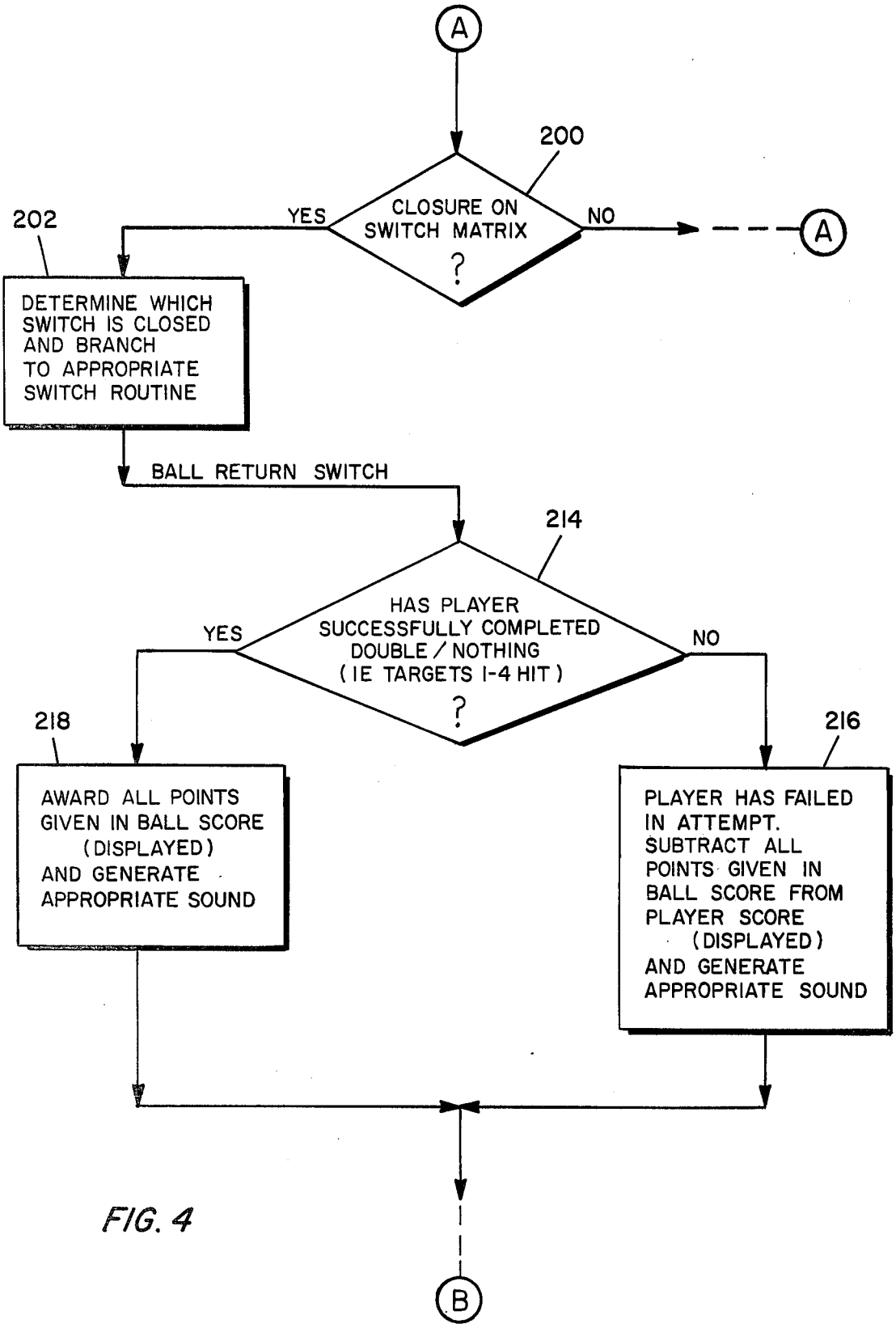
FIG. 4 illustrates in flow chart form the processor's sub routine for scoring after completion of the ball in play.

In FIGS. 3 and 4, flow charts are presented to depict the operation of the sub routine of the scoring system according to the invention in a program sub routine format. Within the program in a software format, there is a switch decode routine which analyzes the particular closure of the switch matrix, this being depicted in diamond block 200 which is the "decision" block, that is the determination of whether or not a particular event has occurred. If the closure has occurred on the switch matrix, the "yes" branch is followed to the next block 202 to determine which switch has been closed for branching to an appropriate switch sub routine. In the instant case, being concerned with the double or nothing scoring mode, if the double or nothing switch has been closed the next decision is represented in diamond block 204 to determine whether or not a ball is in play. If the answer is "yes" in accordance with block 206 the closure is invalid and therefore ignored. If there is no ball in play, the next step in the sub routine is shown in diamond block 208 whereupon it is determined whether or not the particular player has previously selected the double or nothing scoring mode. If the player has previously selected this scoring mode, in accordance with block 210 the closure is invalid and therefore ignored or the switch is still being depressed. If the player has not previously selected the double or nothing scoring mode, then, in accordance with block 212 the player's double or nothing "flag" is set and simultaneously the display 90 shown in FIG. 1 may be illuminated to indicate the selection. In accordance with block 212 the game double or nothing flag is likewise set to indicate the player's selection of that feature for this game, this being accomplished within processor unit 102 shown in FIG. 2. The targets may then be illuminated, that is targets 70–73 to indicate the scoring mode in progress and certain sounds may be generated from the console 80 to indicate player's selection of this mode.

The play then proceeds for that particular ball once that mode has been selected and, referring to FIG. 4, the program routine, sensing the closure of the ball return switch 138 in diamond block 200, the routine then branching to block 202 to determine the particular switch closed. In accordance with diamond block 214 the play is examined with respect to the targets to determine whether or not the player has successfully impacted all targets for that ball. If he has not successfully completed impacting all targets, the program branches to block 216 indicating that the player has failed and all points given for ball score are deducted from the player's score which is displayed. Suitable sounds may be generated to indicate the failure.

If the player has successfully impacted all targets for that ball, the routine then branches to block 218 wherein the player is awarded all points given in the ball score which are then added to the player's score which is displayed with an appropriate sound generated indicative of success. As previously mentioned, the displayed game score for that player will have included in it the starting points plus all points accumulated on that particular ball and block 218 then adds to that score so displayed the total of the ball score register.

As can be seen, as hereinabove shown and described, the amusement value of the pinball machine game can be substantially enhanced when a player elects to test his skill against the machine on a "double or nothing" scoring basis. For any particular ball during that game, including the first ball, a player can rely on skill and chance in effecting a score for that ball equivalent to double that which would normally be provided assuming success of course. In the event of failure, the player gets nothing on that ball although the game score up to that time accumulated for that player still remains his score. While there has been shown and described a preferred embodiment, it is to be understood that various other adaptations and modifications may be made within the spirit and scope of the invention.

What is claimed is:

1. In a game apparatus for a plurality of players wherein each player takes a given number of turns per game for scoring points by actuating any one or more of a number of targets in response to an at least partially player-controlled object device, said game comprising:

player operable means for selecting a scoring mode for that turn;

a predetermined plurality of target means;

means for detecting the actuation of each of said predetermined plurality of target means;

a first register means for accumulating the score of the player for that game;

a second register means for accumulating the score of the player for that turn;

means for sensing completion of that player's turn; and means responsive to said sensing means, said detecting means and selection of said player operable means for altering the contents of said first register means by the contents of said second register means.

2. The combination according to claim 1 wherein said means for altering includes means for adding the contents of said second register means to said first register means in response to actuation of all of said predetermined plurality of target means.

3. The combination according to claim 2 wherein said means for altering includes means for subtracting the contents of said second register means from said first register means in response to actuation of less than all of said predetermined target means.

4. The combination according to claim 3 wherein said game apparatus further includes means for inhibiting selection of said player operable means more than one turn per player per game.

5. The combination according to claim 3 wherein said game apparatus further includes means for displaying the score of said first register means.

6. In a game apparatus such as a pinball machine or the like wherein a plurality of players each take a given number of turns per game for scoring points in response to actuation of any one or more of a number of targets in response to contact with said targets by a ball on a playing surface, the contact of the ball with the target producing scores which are then displayed, the combination comprising:

player operable means for varying the normal scoring mode for that turn;

a predetermined set of targets on the playing surface;

means for detecting the contact of the ball with each of said targets;

a first register means for accumulating the score of that player for that game;

a second register means for accumulating the score of the player for that turn;

means operable in response to movement of the ball for sensing completion of that player's turn; and means responsive to said sensing means, said detecting means and the selection of said player operable means for altering the contents of said first register means by the contents of said second register means.

7. The combination according to claim 6 wherein said game apparatus further includes means for sensing a ball in play for inhibiting the selection of said player operable means.

8. The combination according to claim 7 wherein said game apparatus further includes means for inhibiting selection of said player operable means for that player more than one turn per game.

9. The combination according to claim 6 wherein said means for altering includes means for adding the contents of said second register means to said first register means in response to actuation of all of said target means.

10. The combination according to claim 9 wherein said means for altering includes means for subtracting the contents of said second register means from said first register means in response to actuation of less than all of said target means.

11. The combination according to claim 10 wherein said means for detecting the actuation of each of said target means includes switch means.

12. The combination according to claim 11 wherein said game apparatus further includes means for displaying the score associated with said first register means.

13. The combination according to claim 12 wherein said game apparatus includes a ball return area and said means for sensing completion of that player's turn includes a switch in the ball return area operable in response to contact with said ball.

* * * * *